US006718797B2

(12) United States Patent
Plumly

(10) Patent No.: US 6,718,797 B2
(45) Date of Patent: Apr. 13, 2004

(54) JEWELRY SYSTEM INCLUDING A LOCKET CLASP FOR CONVERSION OF A BRACELET INTO A NECKLACE

(76) Inventor: Margaret Plumly, P.O. Box 6012, Incline Village, NV (US) 89450

( * ) Notice: Subject to any disclaimer, the term of this patent is extended or adjusted under 35 U.S.C. 154(b) by 0 days.

(21) Appl. No.: 09/834,687

(22) Filed: Apr. 13, 2001

(65) Prior Publication Data

US 2002/0148251 A1 Oct. 17, 2002

(51) Int. Cl.[7] ..... A44C 15/00

(52) U.S. Cl. ..... 63/18; 63/19; 63/1.11; 63/3.2

(58) Field of Search ..... 63/1.11, 1.16, 63/1.17, 3, 3.1, 3.2, 21, 18, 19

(56) References Cited

U.S. PATENT DOCUMENTS

| | | | | | |
|---|---|---|---|---|---|
| 3,481,155 | A | | 12/1969 | Cook | 63/2 |
| 4,271,684 | A | * | 6/1981 | Tisdale | 63/19 |
| 4,562,619 | A | * | 1/1986 | Plaza | 24/116 R |
| 4,611,368 | A | * | 9/1986 | Battersby | 24/116 R |
| 4,974,429 | A | | 12/1990 | Ferrara | 63/3 |
| 5,341,659 | A | * | 8/1994 | Wright | 63/1.16 |
| 5,669,242 | A | | 9/1997 | Cayton | 63/21 |
| 5,689,867 | A | * | 11/1997 | Katz | 24/589 |
| 5,722,260 | A | * | 3/1998 | Mangano | 63/3.1 |
| 6,014,871 | A | | 1/2000 | Romano | 63/41 |
| 6,422,036 | B1 | * | 7/2002 | Giannis et al. | 63/3.1 |

FOREIGN PATENT DOCUMENTS

| | | | | |
|---|---|---|---|---|
| GB | 2314252 | A | * 12/1997 | A44C/1/00 |

* cited by examiner

*Primary Examiner*—Robert J. Sandy
*Assistant Examiner*—Dinesh Melwani
(74) *Attorney, Agent, or Firm*—Nixon Peabody LLP; Jerome W. Massie

(57) ABSTRACT

A jewelry finding is provided as a neck accessory that enables a flexible bracelet to be worn as a necklace. Locket clasps are provided at the ends of the neck accessory to provide secure interconnection of the bracelet clasp ends with the neck accessory, while at the same time enclosing and obscuring from view the connection hardware. According to an alternate embodiment, a universal approach is implemented that uses flexible loops to modify clasp ends of most any flexible bracelet to be connectible to fastening posts in the locket clasps of the neck accessory.

25 Claims, 7 Drawing Sheets

JEWELRY SYSTEM INCLUDING A LOCKET CLASP FOR CONVERSION OF A BRACELET INTO A NECKLACE

CROSS REFERENCE TO RELATED APPLICATIONS

This application is related to U.S. application Ser. No. 09/669,284, filed Sep. 26, 2000 by Margaret Plumly. The Ser. No. 09/669,284 application is incorporated by reference herein, in its entirety, for all purposes.

INTRODUCTION

The present invention relates generally to the field of jewelry. More particularly, the present invention relates to jewelry findings that permit conversion of pieces of jewelry between a bracelet configuration and a necklace configuration.

BACKGROUND OF THE INVENTION

Adornment of the human body with jewelry undoubtedly predates recorded history. Jewelry is manufactured in a wide range of different styles to match the personal preferences of the wearer. Jewelry is also manufactured to be worn at different locations on the body to provide different types of accents in accordance with the personal preferences of the wearer. An entire class of jewelry is directed to objects that encircle a body part: rings, bracelets, armbands, necklaces, crowns, and the like.

Commonly, these body encircling jewelry pieces have a fixed size. In many cases, their size is adjustable by deformation (plastic or elastic), by utilizing a hook or clasp which can be attached at any point on a series of open links, or by removing material (grinding away of material or removing chain links). Such size changes are usually only incremental. Adjustment by grinding or removing chain links is inconvenient at best.

Prior art bracelets typically are sufficiently long to fit comfortably around the wrist of the wearer, but are sufficiently short to prevent the bracelet from sliding off over the hand. The average length of a commercially produced bracelet is 7 inches. With the exception of small infants, perhaps, people cannot wear 7 inch bracelets around their necks because they won't fit.

A jewelry system is known in the art, which has a necklace assembly including auxiliary findings. Various portions of the system may be connected to form a bracelet. For further detail, refer to U.S. Pat. No. 6,014,871 to Romano. This known jewelry "system" does not provide a way to make a flexible bracelet wearable around one's neck. It is also noted that the inelegant connecting hardware between the necklace assembly and its auxiliary findings are visible to observers.

A clasping device has been proposed that may be used to connect together necklaces. The connecting hardware of the clasping device is disposed on the back side of ornamental front pieces. For further details, refer to U.S. Pat. No. 4,562,619 to Plaza. This device is prone to flip or roll over so as to expose the connecting hardware in an aesthetically displeasing way.

Lockets are known in the art that provide the functionality of selectively hiding small objects (pictures, keys, etc.) from an observer's view. For further details, refer to U.S. Pat. No. 5,511,390 to Mah, or to U.S. Pat. No. 4,882,915 to Porcaro. These lockets do not provide any way to connect together pieces of jewelry.

Thus, what is needed is a way to make a flexible bracelet wearable around one's neck. What is also needed is a jewelry system that connects together in a way that effectively obscures its connection hardware from view.

"Finding" is a term-of-art known to artisans of ordinary skill in the jewelry making art. As understood in the jewelry business, the term "finding" refers to a tool or other object used by a jeweler.

SUMMARY OF THE INVENTION

According to one embodiment, the present invention provides a device that couples to the two ends of a bracelet to form a combination that may be worn around the neck as a necklace. In this way, a flexible bracelet is provided with additional utility as part of a necklace.

It is an object of the present invention to provide a way to make a flexible bracelet wearable around one's neck.

It is another object of the present invention to provide a neck accessory that is combinable with a flexible bracelet to enhance the usefulness of the bracelet so that it may be worn about one's neck.

It is yet another object of the present invention to provide a jewelry system that is configurable so that at least one of its components may be worn alternately around a wrist or around a neck.

It is still another object of the present invention to provide a neck accessory having locket clasps at its ends.

It is a further object of the present invention to provide a neck accessory having interchangeable locket clasps at its ends.

Some of the above objects are obtained by a jewelry finding for use in combination with a flexible bracelet having clasp ends. The jewelry finding includes an elongate neckpiece having a first end and a second end, a first locket clasp affixed to the first end of the elongate neckpiece, and a second locket clasp affixed to the second end of the elongate neckpiece. The first locket clasp and the second locket clasp are adapted for connection to the clasp ends of the flexible bracelet. The locket clasps enclose and obscure this connection from view. Optionally, the neckpiece may be embodied as a single segment or as having more than one segment.

Others of the above objects are obtained by a jewelry retrofit kit for retrofitting one or more flexible bracelets to function as part of a necklace. The kit includes a jewelry finding and one or more flexible loops. The jewelry finding includes an elongate neckpiece having a first end and a second end, a first locket clasp affixed to the first end of the elongate neckpiece, and a second locket clasp affixed to the second end of the elongate neckpiece. The first locket clasp and the second locket clasp are adapted for connection to the clasp ends of the flexible bracelet.

Certain of the above objects are obtained by a jewelry system that includes a flexible bracelet having clasp ends and an accompanying jewelry finding. Locket clasp structures provide connection of the jewelry finding to the clasp ends of the flexible bracelet. The locket clasps enclose and obscure this connection from view.

BRIEF DESCRIPTION OF THE DRAWINGS

Additional objects and advantages of the present invention will be apparent in the following detailed description read in conjunction with the accompanying drawing figures.

DETAILED DESCRIPTION

According to one embodiment, the present invention provides a device that couples to the two ends of a flexible bracelet to form a combination that may be worn around the neck as a necklace. In this way, a flexible bracelet is provided with additional utility as part of a necklace. As meant in the context of this description, the bracelet is the jewelry article to which a neck accessory according to the present invention is to be connected. The bracelet may be essentially any of the various flexible decorative bracelets commonly worn as jewelry.

A neck accessory is defined as a jewelry article (or set of articles) adapted for connection to a flexible bracelet so as to give the bracelet a different usefulness, as compared to that of the bracelet alone. Preferably the neck accessory also has an ornamental aspect wherein it gives the bracelet an enhanced visual appearance, as compared to that of the bracelet alone.

The manner of connection of a bracelet to a neck accessory is an aspect of the present invention that is not dealt with in the prior art in any satisfactory way. The types of clasps and fasteners used to couple together the ends of flexible bracelets are many and varied. This presents a problem of flexibility of use because a neck piece specifically designed to couple to the clasp ends of a particular bracelet are unsuitable for connecting the diverse clasp ends of almost all other types of bracelets.

According to one embodiment of the present invention, a neck accessory is manufactured specifically matching fastening posts at the ends of the neck accessory to the clasp ends of a particular bracelet. Optionally, the present invention implements a universal approach that uses flexible loops to modify clasp ends of most any flexible bracelet to be connectible to the fastening posts on the ends of the neck accessory. The flexible loops are often not necessary, though, since many bracelet clasp ends will mount securely to a simple, sufficiently thin post.

A problem is also presented that known ways of fastening together jewelry pieces for wear about the neck do not provide a reliable way of obscuring the connection hardware from view. If the jewelry simply rolls over half a turn the connection hardware is exposed to view, which is generally undesirable from an aesthetic point of view. According to the present invention, the fastening posts at the end of the neck accessory are each combined with a pair of locket halves that enclose the fastening posts to form locket clasps. The locket clasps formed by this combination obscure from view the interconnection of the bracelet clasp ends with the posts.

Figure 1:
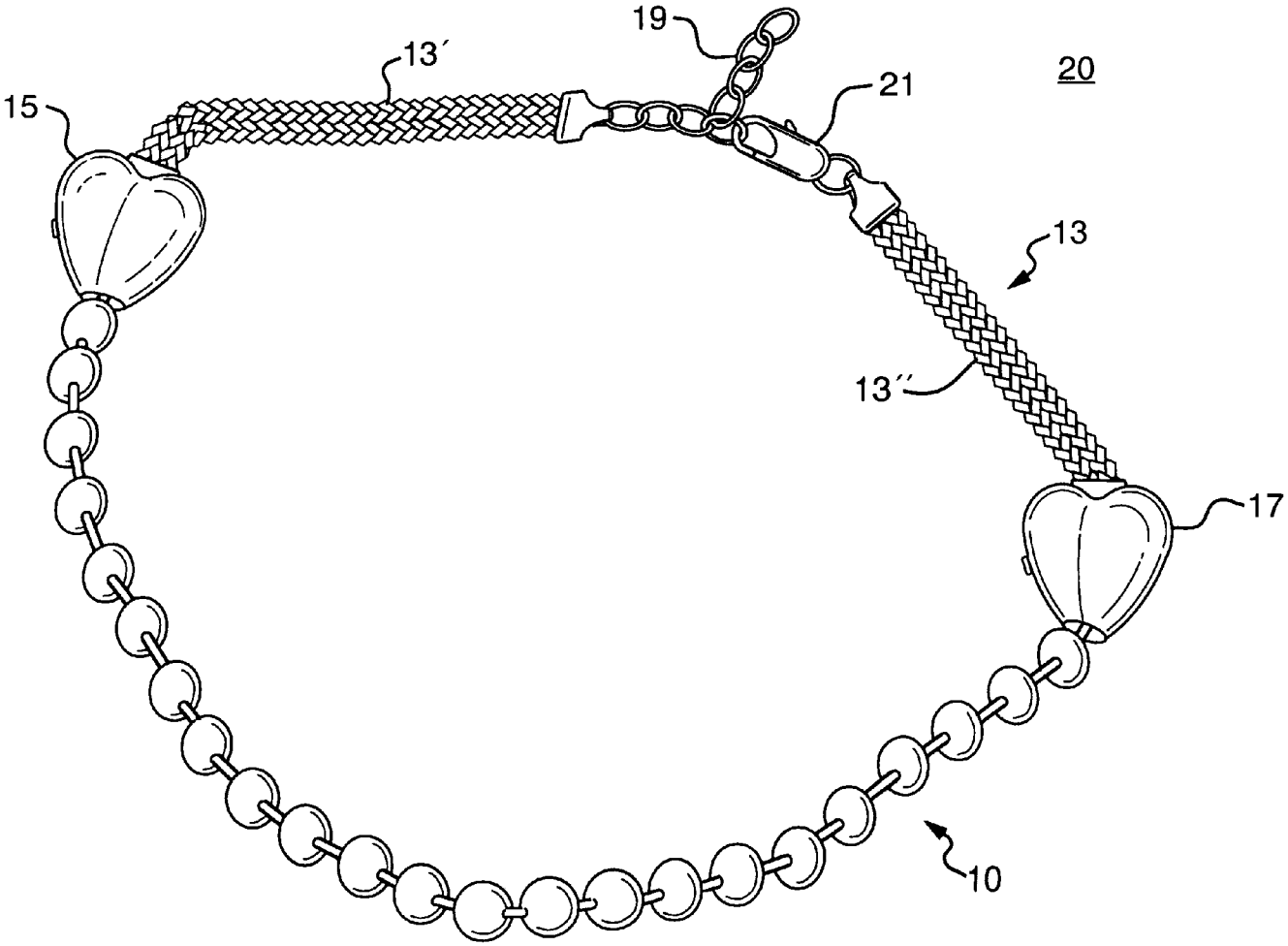
FIG. 1 illustrates a bottom plan view of a pearl bracelet in combination with a neckpiece embodied according to the present invention.

Referring to FIG. 1, a pearl bracelet in combination with a neck accessory embodied according to the present invention (shown in bottom plan view) is illustrated. A flexible pearl bracelet 10 is connected to a neckpiece 13 that terminates at locket clasps 15, 17 that connect the bracelet 10 to the neckpiece 13. This view shows the side of the bracelet/neckpiece combination 20 that rests against the skin of the wearer. A clasp 21 is connectible to any of a plurality of links 19 to provide choice of the loop length of the bracelet/neckpiece combination 20.

The neckpiece 13 comprises two detachable parts 13', 13" that connect via the clasp 21 and links 19. According to this embodiment the neckpiece parts 13', 13" are each flexible. Preferably, the flexibility is provided by a broad woven metal-type structure. Alternately, any flexible link structure may be used, or a non-flexible solid piece may be used.

Figure 2:
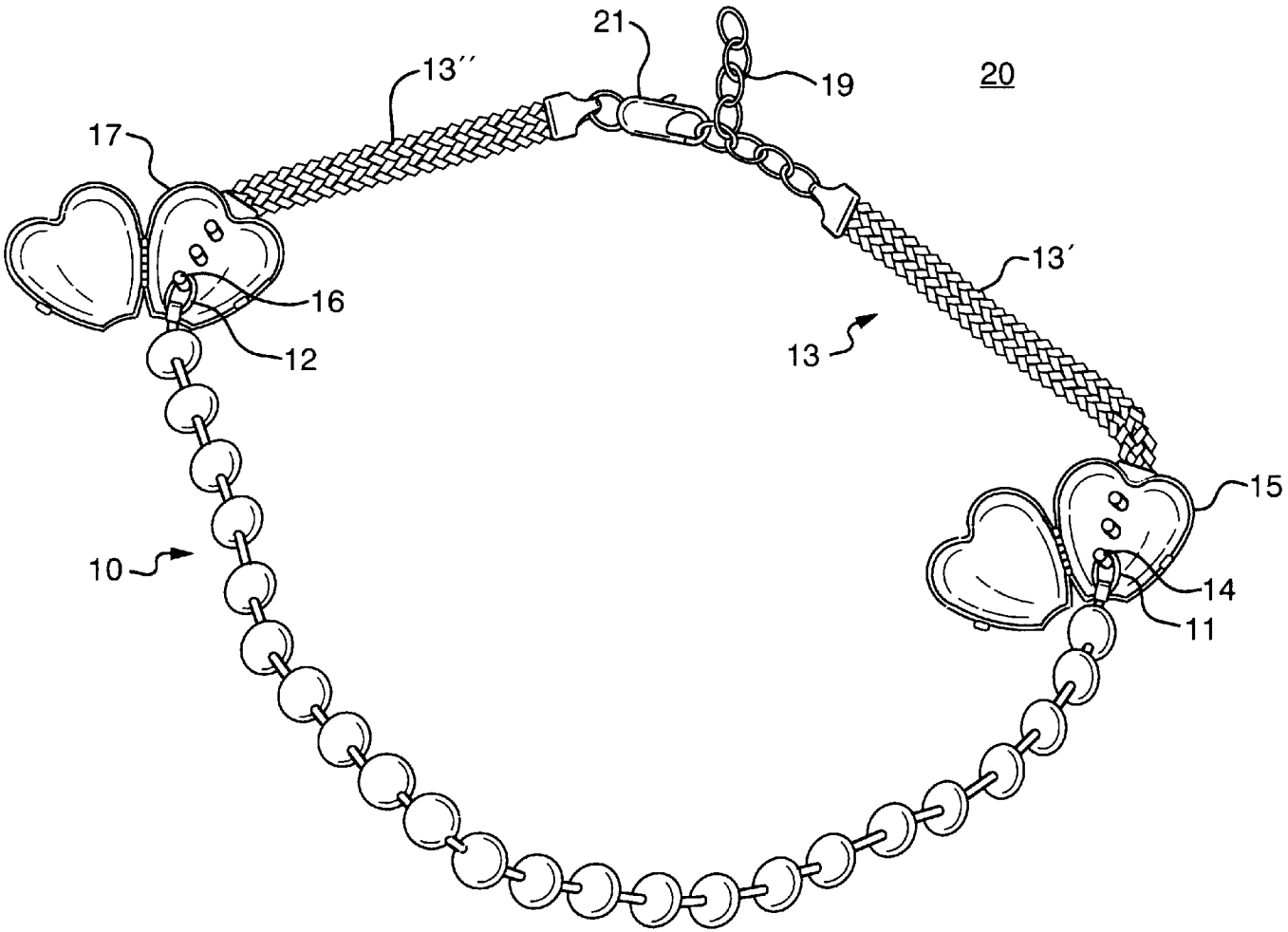
FIG. 2 illustrates a top plan view of the combination of FIG. 1, with the locket clasps open.

Referring to FIG. 2, another view of the combination of FIG. 1 (i.e., a top plan view) is illustrated. The bracelet 10 is connected via its end clasps 11, 12 to respective posts 14, 16 of the neckpiece 13. The posts 14, 16 are disposed inside the locket clasps 15, 17. This view shows the side of the bracelet/neckpiece combination visible to an observer when the necklace is being worn. The locket clasps 15, 17 are both shown in the open position, with their posts 14, 16 exposed for view. In normal wear, the locket clasps 15, 17 are maintained in a closed position.

Figure 3:
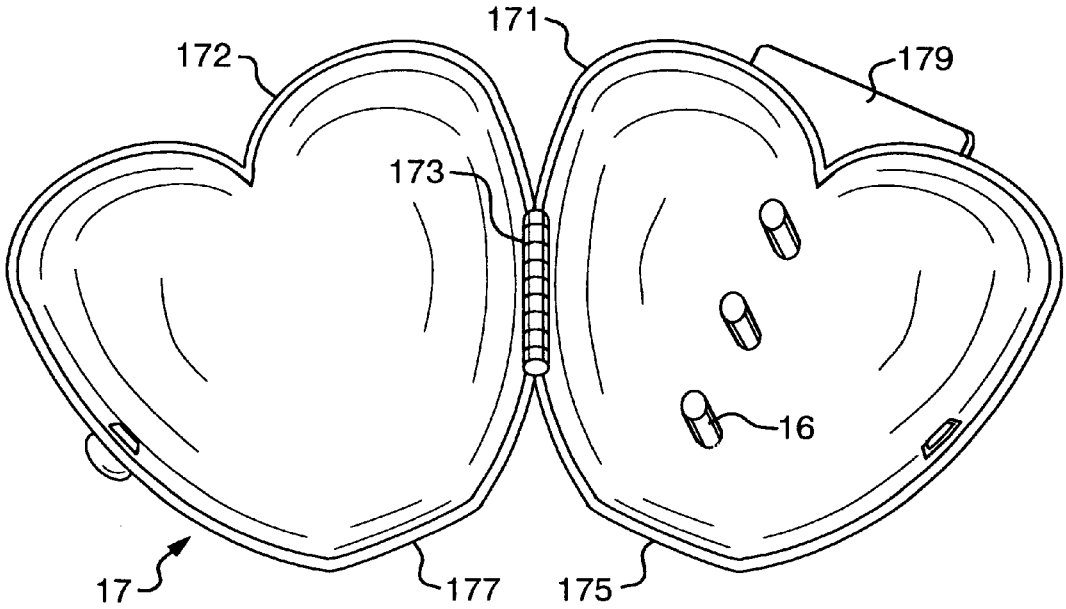
FIG. 3 illustrates a detail top plan view of one opened locket clasp according to the embodiment of FIGS. 1 and 2.

Referring to FIG. 3, one locket clasp according to the embodiment shown in FIGS. 1 and 2 is illustrated. The relative positioning of posts 16 inside a locket clasp 17 is shown, the connecting bracelet being omitted for ease of illustration. As illustrated, the post 16 is a simple vertical member projecting from the bottom half 171 of the locket clasp 17, but other suitable fastening devices may be employed. The locket clasp 17 is shown in the open position with the top half 172 being connected to the bottom half 171 by a hinge 173. A dip formed at the lower end 175 of the bottom half 171, as well as at the lower end 177 of the top half 172, so that when the locket halves 171, 172 are closed together a gap is formed between their lower ends 175, 177. It is through this gap that an end of the bracelet passes.

A connecting member 179 is formed across the top end of the bottom half 171 of the locket clasp 17 as a secure fastening point for the woven structure of the neckpiece (not shown in this view).

In cases where the end of the bracelet has an open loop or chain link, then the bracelet end is easily fastened to the neckpiece by opening the locket clasp 17, placing the open loop or chain link on a post 16 and then closing the locket clasp 17. The posts 16 each have a length chosen such that they extend from the bottom half 171 (on which they are secured) to the top half 172. In this way the locket clasp 17 provides for a secure connection of the bracelet end to the neckpiece. The number and positioning of the posts 16 is chosen so as to provide diversity of fastening points. Although the locket clasp 17 is illustrated with three posts 16, the invention may be successfully practiced with more or fewer posts 16, or even with only a single post 16 to provide a single fastening point.

Other fastening members are optionally useful in lieu of the simple posts illustrated. Hooks, ring clips, and clasps are all good options to provide the fastening function. The fastening members need not be simple straight posts as illustrated, but may be embodied as being curved, J-shape, Z-shaped, or any other useful shape.

Figure 4:
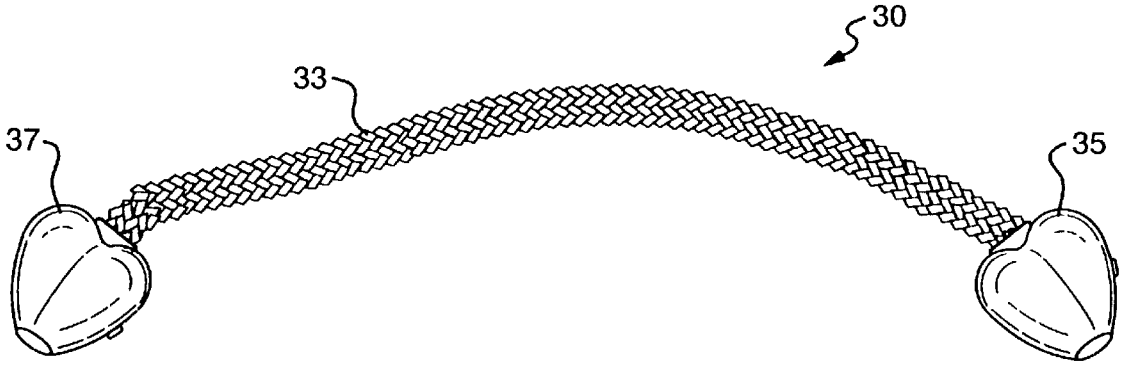
FIG. 4 illustrates a top plan view of a neckpiece according to an alternate embodiment of the present invention.

Referring to FIG. 4, a neckpiece 30 according to an alternate embodiment of the present invention is illustrated. A single flexible structure 33 extends between two locket clasps 35, 37. The flexible structure 33 is preferably woven metal. For simplicity, the flexible structure 33 is uninterrupted by any clasp structure. Omission of any clasp structure from the neckpiece 30 is appropriate when the neckpiece 30 is sufficiently long so that the length of the neckpiece 30 in combination with a bracelet will be long enough to allow for both the wearer's comfort as well as the proper outward display of the bracelet component. Optionally, the single flexible structure 33 is embodied as a non-flexible, solid piece.

Figure 5A:
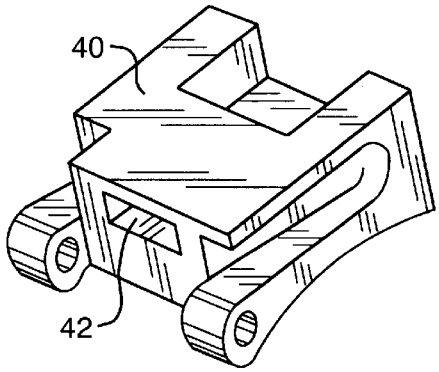
FIG. 5A illustrates a perspective detail view of clasp link of a bracelet.

Referring to FIG. 5A, a clasp link 40 of a bracelet is illustrated. This is a clasp link that is common for use on bracelets in the prior art. In particular, this clasp link is commonly used in bracelets known as "tennis" bracelets. Since it is not in the shape of a large, open loop or chain link, it cannot be connected directly to a post such as that shown in FIG. 3. In order to facilitate connection of such a prior art clasp link 40 to a post in a locket clasp, the clasp link 40 is modified by addition of a flexible loop 50 through a channel 42 in the clasp link.

Figure 5B:
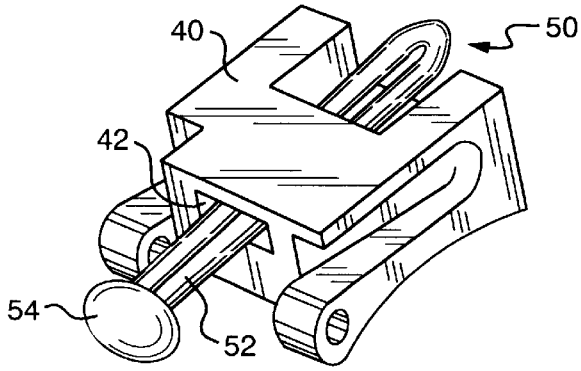
FIG. 5B illustrates a perspective detail view of a flexible loop (including an attached bead) being threaded through a bracelet clasp link.

Referring to FIG. 5B, a flexible loop 50 according to an embodiment of the present invention is illustrated while being threaded through a bracelet clasp link 40. The flexible loop 50 comprises a looped length of nylon filament 52 connected to a bead 54. The looped length of nylon filament 52 is threaded through a channel 42 in the clasp link 40. A V-shaped wire (not shown) akin to that used to thread a needle may be advantageously used to aid in threading the filament 52 through the channel 42, since the parts may be small for some bracelets. Although the filament 52 is preferably embodied in nylon, any suitable flexible fiber may be used. For example, cotton or GORETEX™ fibers are successfully employed to embody the filament 52.

Figure 5C:
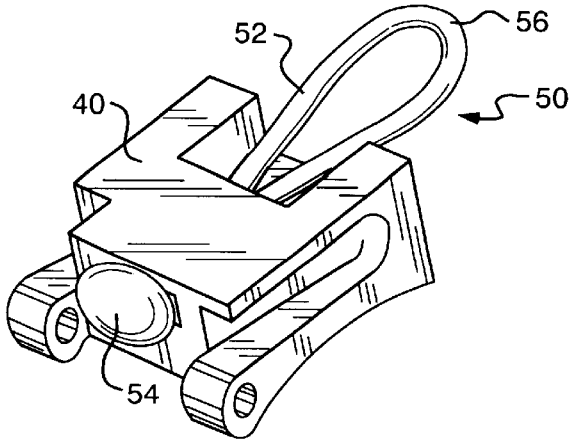
FIG. 5C illustrates a perspective detail view of a bracelet clasp link in combination with a flexible loop (the attached bead prevents the flexible loop from pulling completely through the clasp).

Referring to FIG. 5C, a bracelet clasp link 40 in combination with a flexible loop 50 according to an embodiment of the present invention is illustrated. The looped length of nylon filament 52 had been pulled all the way through the channel 42 so that the bead 54 rests against the body of the clasp link 40. The free end 56 of the flexible loop 50 is free to be easily connected to a post in one of the locket clasps of the neckpiece.

Depending on the configuration of the clasp, the flexible loop 50 may optionally be inserted the opposite direction from that shown in FIGS. 5B and 5C, with the bead 54 being substantially obscured from view. For brevity, only the one direction has been illustrated.

Figure 6A:
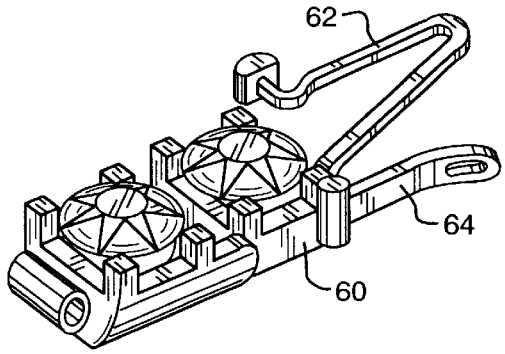
FIG. 6A illustrates a perspective detail view of clasp link of a bracelet.

Referring to FIG. 6A, a clasp link 60 of a bracelet is illustrated. This is another clasp link that is common for use on bracelets in the prior art, and like the link 40 of FIG. 5A is not in the shape of a large, open loop or chain link. Thus, it cannot easily be connected directly to a locket clasp's post such as that shown in FIG. 3. In order to facilitate connection of such a prior art clasp link 60 to a fastener clip, the clasp link 60 is modified by addition of a flexible loop 70 through the catch tip 62.

Figure 6B:
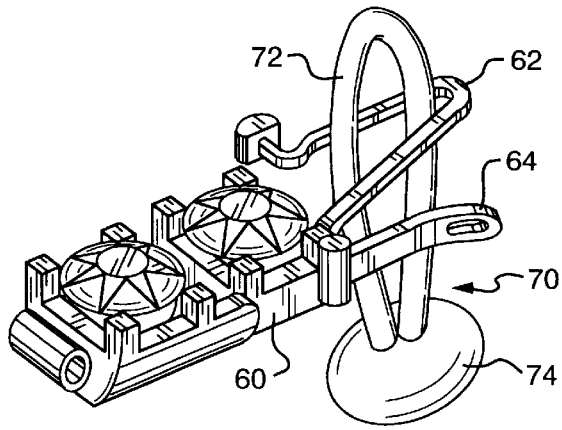
FIG. 6B illustrates a perspective detail view of a flexible loop (including an attached bead) being threaded through a bracelet clasp link.

Referring to FIG. 6B, a flexible loop 70 according to an embodiment of the present invention is illustrated while being threaded through the bracelet clasp link 60. The flexible loop 70 comprises a looped length of nylon filament 72 connected to a bead 74. The looped length of nylon filament 72 is threaded through a catch tip 62 in the clasp link 60.

Figure 6C:
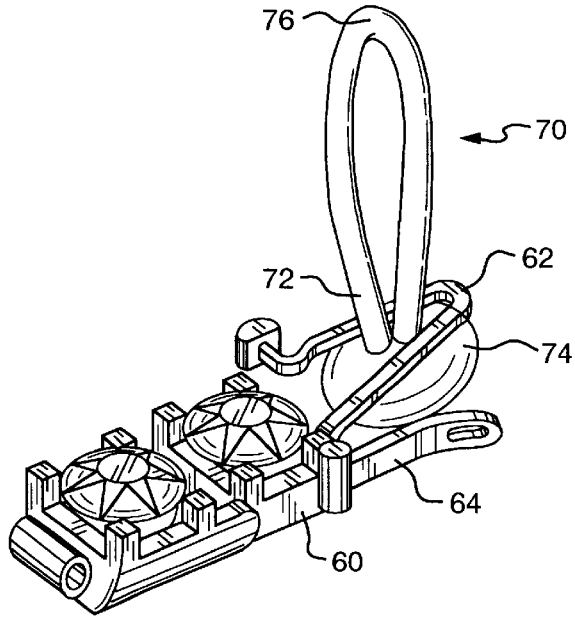
FIG. 6C illustrates a perspective detail view of a bracelet clasp link in combination with a flexible loop (the attached bead prevents the flexible loop from pulling completely through the catch tip of the clasp).

Referring to FIG. 6C, a bracelet clasp link 60 in combination with a flexible loop 70 according to an embodiment of the present invention is illustrated. The looped length of nylon filament 72 had been pulled all the way through the catch tip 62 so that the bead 74 rests against the catch tip 62. The free end 76 of the flexible loop 70 is free to be easily connected to a post in one of the locket clasps of the neckpiece.

According to an alternate embodiment an elastic band (not shown) may be added to the combination shown in FIG. 6C to encircle the clasp link 60 and retain a hinged portion 64 to prevent it from flopping about freely. Use of such an elastic band is not essential to the practice of the present invention, but adds an additional functionality.

According to another alternate embodiment, thin rigid members are employed in lieu of the flexible loops described above. The thin rigid members are sufficiently small to thread through the clasp end of a bracelet and provide a fastening point onto the locket clasp of the neck accessory according to the present invention. This use of rigid members provides a functionality equivalent to that of the flexible loops.

Figure 7:
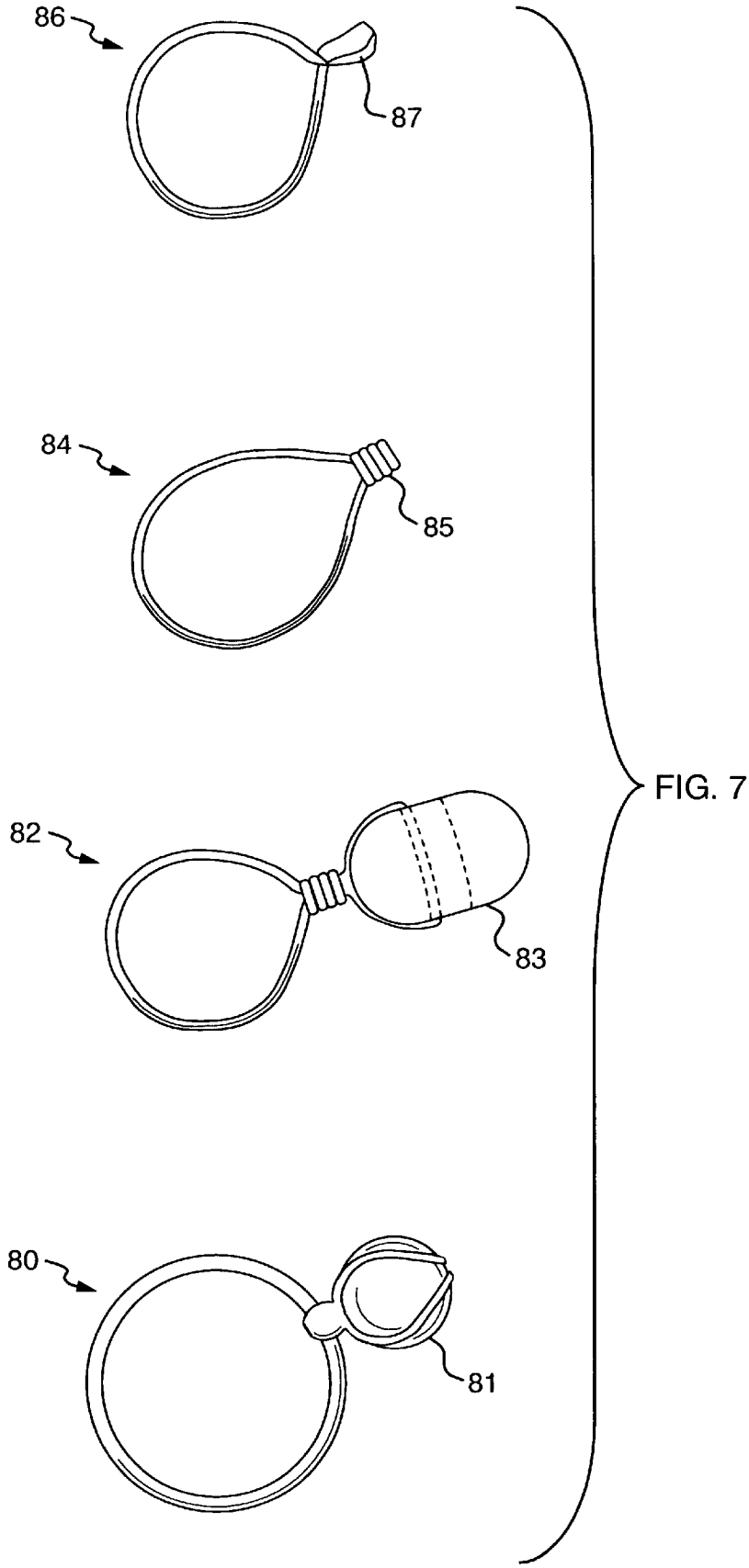
FIG. 7 illustrates a detail view of flexible loops according to the present invention.

Referring to FIG. 7, flexible loops 80, 82, 84, 86 according to different embodiments of the present invention are illustrated. The use of beads 81, 83 of varying sizes are shown. A bead is defined to encompass a piece of material pierced for threading, as well as a blob or line of weld material. Alternately, simple crimped metal pieces 85, 87 are substituted for beads. The beads or crimped metal pieces are not strictly necessary for practice of the present invention, as any solid object of an appropriate size may be fastened to a flexible filament to form a suitable loop for threading through a bracelet clasp link.

It is also noted that the present invention may be practiced using flexible loops that are made solely of flexible filament, without any catch object such as beads or crimped metal pieces. To implement this alternate embodiment, the flexible loop is threaded through an appropriate channel or opening in the clasp link and then threaded back through itself, by attaching directly to clasp openings (such as spring ring) or by other methods devised by the wearer.

Figure 8:
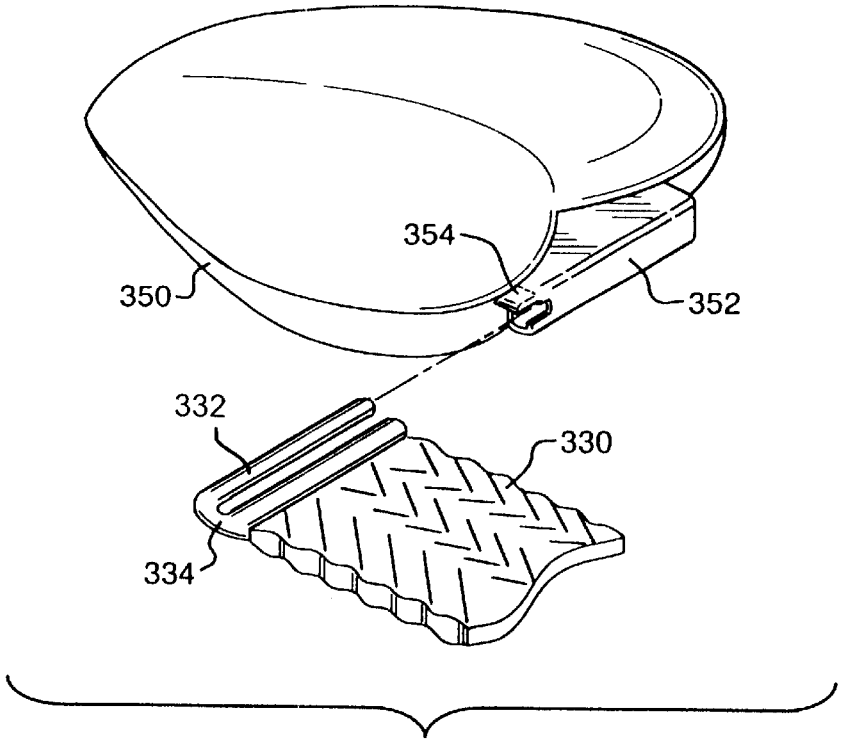
FIG. 8 illustrates an exploded detail view of connection of a locket clasp of a neck accessory to a chain structure.

Referring to FIG. 8, an exploded detail view of the connection of a locket clasp to a chain neckpiece structure is illustrated. The locket clasp 350 connects to the chain structure 330 by engagement of the prong 332 into the receiving channel 352. The prong 332 is retained in the channel 352 by bending engagement of a tab 352 with the curved end 354 of the prong. This is one example of a detachable connection arrangement. Alternate connection arrangements (e.g., reversing the male and female elements, magnetic connectors, other connector types, etc.) can be successfully implemented for joining the locket clasp 350 to a chain structure 330.

Figure 9:
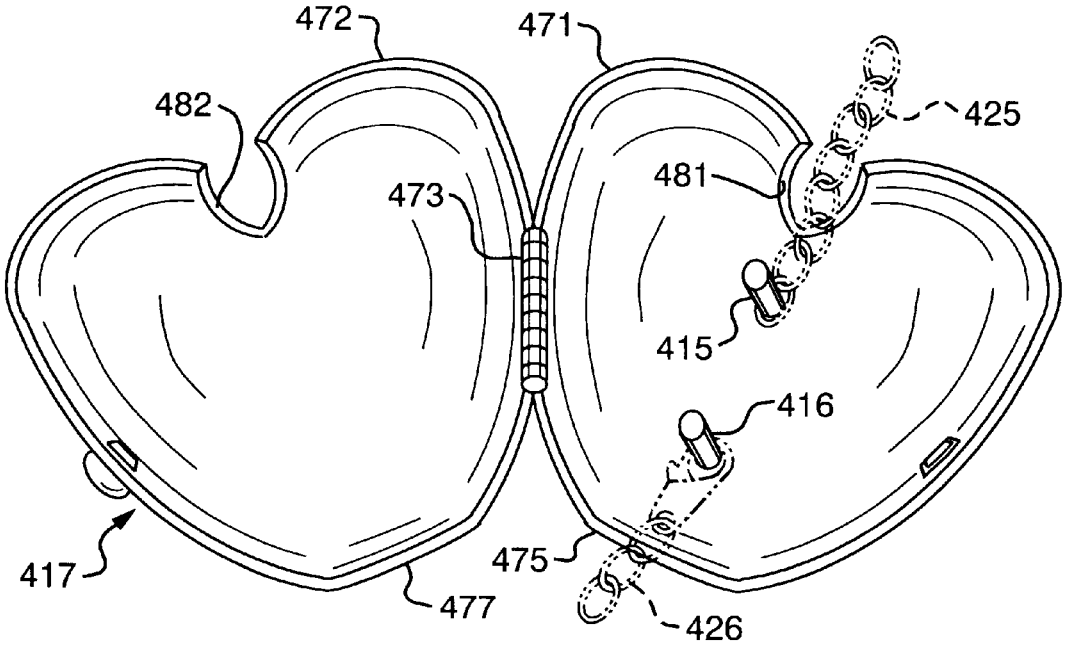
FIG. 9 illustrates one locket clasp according to another embodiment.

Referring to FIG. 9, one locket clasp according to another embodiment is illustrated. The locket clasp 417 is shown in the open position with the top half 472 being connected to the bottom half 471 by a hinge 473. A dip is formed at the lower end 475 of the bottom half 471, as well as at the lower end 477 of the top half 472, so that when the locket halves 471, 472 are closed together a gap is formed between their lower ends 475, 477. It is through this gap that an end of the bracelet 426 passes. The bracelet 426 engages with a bracelet fastening post 416. As illustrated, the bracelet fastening post 416 is a simple vertical member projecting from the bottom half 471 of the locket clasp 417, but other suitable fastening devices (hooks, ring clasps, etc.) may be employed.

A dip 481 is formed at the top end of the bottom half 471 and a complementing dip 482 is formed at the top end of the top half 472, so that when the locket halves 471, 472 are closed together a second gap is formed by the dips 481, 482 at the top end of the locket clasp 417. It is through this second gap that the neckpiece 425 passes. The neckpiece 425 engages with a neckpiece fastening post 415. The neckpiece fastening post 415 is a simple vertical member projecting from the bottom half 471 of the locket clasp 417, but other suitable fastening devices (hooks, ring clasps, etc.) may be employed.

The bracelet 426 and neckpiece 425 are shown as chains for ease of illustration, but may take any suitable form. They may simply slip over posts 416, 415, as shown, or may connect to the posts via flexible loops (as described above), or may couple to the locket clasp via custom connectors adapted for the specific shape of the clasp ends of the bracelet 426 or neckpiece 425. The posts 416, 415 each has a length chosen so as to extend from the bottom half 471 (on which the posts are secured) to the top half 472. In this way the locket clasp 417 provides for a secure connection of the ends of the bracelet and neckpiece to the locket clasp.

The neckpiece that connects between the locket clasps has been described variously herein as being different types of flexible chain or as being a solid piece. The particular construction, shape, or form of the neckpiece that joins the locket clasps is not a critical aspect of the invention and may be embodied using any known technology or future technology. For example, a flexible neckpiece is advantageously made from textile, leather, polymer, or ribbon and a rigid neckpiece is advantageously made from wood, metal, or polymer.

Likewise, the locket clasps can be advantageously formed from metal, polymer, wood, or any other natural or man-made material.

The present invention has been described in terms of preferred embodiments, however, it will be appreciated that various modifications and improvements may be made to the described embodiments without departing from the scope of the invention. The present invention is limited only by the scope of the claims appended hereto.

What is claimed is:

1. A jewelry combination comprising:

a flexible, elongate jewelry strand having a first clasp end and a second clasp end;

a flexible, elongate finding strand having a first end and a second end;

a first hollow locket clasp having a first end which includes an opening to the interior, a second closed end, a first fastening member on an interior surface thereof and a second fastening member on an exterior surface at the second closed end;

a second hollow locket clasp having a first end which includes an opening to the interior, a second closed end, a first fastening member on an interior surface thereof and a second fastening member on an exterior surface at the second closed end, wherein the first clasp end of the flexible, elongate jewelry strand extends through the opening of said first hollow locket clasp and is detachably affixed to the first fastening member of the first hollow locket clasp and the second clasp end of the flexible, elongate jewelry strand extend through the opening of said second hollow locket clasp and is detachably affixed to the first fastening member of the second hollow locket clasp such that the first and second clasp ends are obscured from view, and wherein the first end of the flexible, elongate finding strand is affixed to the second fastening member of the first hollow locket clasp and the second end of the flexible, elongate finding strand is affixed to the second fastening member of the second hollow locket clasp.

2. The jewelry combination of claim 1, wherein the first and second hollow locket clasps each comprise:

a locket bottom part and a mating locket top part rotatably affixed to the locket bottom part, wherein the first fastening member and the second fastening member of each hollow locket clasp is positioned on the locket bottom part.

3. The jewelry combination of claim 1, wherein the first fastening member of the first and second hollow locket clasps is selected from the group consisting of a post, a hook, a ring clip, a flexible loop and a clasp.

4. The jewelry combination of claim 1, wherein each of the first second hollow locket clasps include at least one additional fastening member on the interior surface for detachably receiving the first clasp end and second clasp end of the flexible, elongate jewelry strand in order to adjust the length of the jewelry combination.

5. The jewelry combination of claim 1, wherein the flexible, elongate jewelry strand is a bracelet.

6. The jewelry combination of claim 1, wherein the jewelry combitiation is a necklace.

7. A jewelry combination comprising:

a flexible, elongate jewelry strand having a first clasp end and a second clasp end;

a flexible, elongate finding strand which comprises, a first separate flexible elongate finding strand including at one end thereof a first end and at another end thereof a detachable clasp end, and a second separate flexible elongate finding strand including at one end thereof a second end and at another end thereof a detachable clasp end;

a first hollow locket clasp having a first end which includes an opening to the interior, a second closed end, a first fastening member on an interior surface thereof and a second fastening member on an exterior surface at the second closed end;

a second hollow locket clasp having a first end which includes an opening to the interior, a second closed end, a first fastening member on an interior surface thereof and a second fastening member on an exterior surface at the second closed end, wherein the first clasp end of the flexible, elongate jewelry strand extends through the opening of said first hollow locket clasp and is detachably affixed to the first fastening member of the first hollow locket clasp and the second clasp end of the flexible, elongate jewelry strand extends through the opening of said second hollow locket clasp and is detachably affixed to the first fastening member of the second hollow locket clasp such that the first and second clasp ends are obscured from view, wherein the first end of the flexible, elongate finding strand is affixed to the second fastening member of the first hollow locket clasp and the second end of the flexible, elongate finding strand is affixed to the second fastening member of the second hollow locket clasp, and, wherein the detachable clasp end of the first and second separate flexible elongate finding strands are detachably secured together.

8. The jewelry combination of claim 7, wherein the first and second hollow locket clasps each comprise:

a locket bottom part and a mating locket top part rotatably affixed to the locket bottom part, wherein the first fastening member and the second fastening member of each hollow locket clasp is positioned on the locket bottom part.

9. The jewelry combination of claim 7, the first and second fastening member of the first and second hollow locket clasps are selected from the group consisting of a post, a hook, a ring clip, a flexible loop and a clasp.

10. The jewelry combination of claim 7, wherein each of the first and second hollow locket clasps includes:

an opening in the second closed end thereof, wherein the second fastening member is positioned on the interior surface of the second end, and wherein the first end of the flexible, elongate finding strand extends through the opening in the second end and is detachably affixed to the second fastening member of the first hollow locket clasp, and the second end of the flexible, elongate finding strand extends through the opening in the second end and is detachably affixed to the second fastening member of the second hollow locket clasp.

11. The jewelry combination of claim 10, wherein each of the first and second hollow locket clasps includes at least one additional fastening member on the interior surface for detachably receiving the first clasp end and second clasp end of the flexible, elongate jewelry strand in order to adjust the length of the jewelry combination.

12. The jewelry combination of claim 11, both the first and second hollow locket clasps each comprise:

a locket bottom part and a mating locket top part rotatably affixed to the locket bottom part, wherein the first fastening member and the second fastening member of each hollow locket clasp is positioned on the locket bottom part.

13. The jewelry combination of claim 7, wherein the flexible, elongate jewelry strand is a bracelet.

14. The jewelry combination of claim 7, wherein the jewelry combination is a necklace.

15. A jewelry finding for detachable assembly with a flexible, elongated jewelry strand having a first clasp end and a second clasp end comprising:

a flexible, elongate finding strand having a first end and a second end;

a first hollow locket clasp having a first end which includes an opening to the interior, a second closed end, a first fastening member on an interior surface thereof and a second fastening member on an exterior surface at the second closed end;

a second hollow locket clasp having a first end which includes an opening to the interior, a second closed end, a first fastening member on an interior surface thereof and a second fastening member on an exterior surface at the second closed end, wherein upon detachable assembly with the flexible, elongate jewelry strand the first clasp end of the flexible, elongate jewelry strand extends through the opening and is detachably affixed to the first fastening member of the first hollow locket clasp and the second clasp end of the flexible, elongate jewelry strand extends through the opening and is detachably affixed to the first fastening member of the second hollow locket clasp such that the first and second clasp ends are obscured from view, and wherein the first end of the flexible, elongate finding strand is affixed to the second fastening member of the first hollow locket clasp and the second end of the flexible, elongate finding strand is affixed to the second fastening member of the second hollow locket clasp.

16. The jewelry finding of claim 15, wherein the first and second clasps each comprise:

a locket bottom part and a mating locket top part rotatably affixed to the locket bottom part, wherein the first fastening member and the second fastening member of each hollow locket clasp are positioned on the locket bottom part.

17. The jewelry finding of claim 15, wherein the first fastening the first and second hollow locket clasps is selected from the group consisting of a post, a hook, a ring clip, a flexible loop and a clasp.

18. The jewelry finding of claim 15, wherein the first and second hollow locket clasps include at least one additional fastening member on the interior surface thereof for detachably receiving the first clasp end and second clasp end of the flexible, elongate jewelry strand in order to adjust the length of the detachably assembled flexible, elongate finding strand, flexible elongate jewelry strand, first hollow locket clasp and second hollow locket clasp.

19. The jewelry finding of claim 15, wherein the flexible, elongate finding strand comprises:

a first separate flexible elongate finding strand including at one end thereof the first end and at another end thereof a detachable clasp end, and a second separate flexible elongate finding strand including at one end thereof the second end and at another end thereof a detachable clasp end, wherein the detachable clasp end of the first and second separate flexible elongate finding strands are detachably secured.

20. A jewelry finding for detachable securing to a flexible, elongate jewelry strand having a first clasp end and a second clasp end comprising:

a flexible, elongate finding strand which comprises, a first separate flexible elongate finding strand including at one end thereof a first end and at another end thereof a detachable clasp end, and a second separate flexible elongate finding strand including at one end thereof a second end and at another end thereof a detachable clasp end;

a first hollow locket clasp having a first end which includes an opening to the interior, a second closed end, a first fastening member on an interior surface thereof and a second fastening member on an exterior surface at the second closed end;

a second hollow locket clasp having a first end which includes an opening to the interior, a second closed end, a first fastening member on an interior surface thereof and a second fastening member at on an exterior surface at the second closed end wherein upon detachable assembly with the flexible, elongate jewelry strand the first clasp end of the flexible, elongate jewelry strand extends through the opening of the first hollow locket clasp and is detachably affixed to the first fastening member of the first hollow locket clasp and the second clasp end of the flexible, elongate jewelry strand extends through the opening of the second hollow locket clasp and is detachably affixed to the first fastening member of the second hollow locket clasp such that the first and second clasp ends are obscured from view, wherein the first end of the flexible, elongate finding strand is affixed to the second fastening member of the first hollow locket clasp and the second end of the flexible, elongate finding strand is affixed to the second fastening member of the second hollow locket clasp, and, wherein the detachable clasp end of the first and second separate flexible elongate finding strands are detachably secured together.

21. The jewelry finding of claim 20, wherein the first and second clasps each comprise:

a locket bottom part and a mating locket top part rotatably affixed to the locket bottom part, wherein the first fastening member and the second fastening member of each hollow locket clasp is positioned on the locket bottom part.

22. The jewelry combination of claim 20, wherein the first and second fastening member of the first and second hollow locket clasps are selected from the group consisting of a post, a hook, a ring clip, a flexible loop and a clasp.

23. The jewelry combination of claim 20, wherein each of the first and second hollow locket clasps include:

an opening in the second closed end thereof, wherein the second fastening member of each of the first and second hollow locket clasps is positioned on the interior surface adjacent second end of each hollow locket clasp, and wherein the first end of the flexible, elongate finding strand extends through the opening in the second end of the first hollow locket clasp and is detachably affixed to the second fastening member of the first hollow locket clasp, and the second end of the flexible, elongate finding strand extends through the opening in the second end of the second hollow locket clasp and is detachably affixed to the second fastening member of the second hollow locket clasp.

24. The jewelry combination of claim 23, wherein the first and second hollow locket clasps include at least one additional fastening member on the interior surface for detachably receiving the first clasp end and second clasp end of the flexible, elongate jewelry strand in order to adjust the length of the detachably assembled flexible, elongate finding strand, flexible elongate jewelry strand, first hollow locket clasp and second hollow locket clasp.

25. The jewelry combination of claim 24, wherein the first and second hollow locket clasps each comprise:

a locket bottom part and a mating locket top part rotatably affixed to the locket bottom part, wherein the first fastening member and the second fastening member of each hollow locket clasp are positioned on the locket bottom part.

* * * * *